US010399339B2

(12) United States Patent
Tonomura et al.

(10) Patent No.: US 10,399,339 B2
(45) Date of Patent: Sep. 3, 2019

(54) NOZZLE PLATE, LIQUID EJECTING HEAD, LIQUID EJECTING APPARATUS, AND MANUFACTURING METHOD OF NOZZLE PLATE

(71) Applicant: Seiko Epson Corporation, Tokyo (JP)

(72) Inventors: Osamu Tonomura, Shimosuwa (JP); Satoshi Suzuki, Chino (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 16/016,741

(22) Filed: Jun. 25, 2018

(65) Prior Publication Data

US 2018/0370232 A1 Dec. 27, 2018

(30) Foreign Application Priority Data

Jun. 26, 2017 (JP) ..... 2017-123993

(51) Int. Cl.
*B41J 2/14* (2006.01)
*B41J 2/16* (2006.01)

(52) U.S. Cl.
CPC ..... *B41J 2/1433* (2013.01); *B41J 2/14233* (2013.01); *B41J 2/161* (2013.01); *B41J 2/162* (2013.01); *B41J 2/1606* (2013.01); *B41J 2/1623* (2013.01); *B41J 2/1628* (2013.01); *B41J 2/1632* (2013.01); *B41J 2/1642* (2013.01); *B41J 2/1646* (2013.01); *B41J 2002/14241* (2013.01); *B41J 2002/14419* (2013.01)

(58) Field of Classification Search
CPC .... B41J 2/1433; B41J 2/14233; B41J 2/1606; B41J 2/161; B41J 2/162; B41J 2/1623; B41J 2/1628; B41J 2/1632; B41J 2/1646
See application file for complete search history.

(56) References Cited

U.S. PATENT DOCUMENTS

2011/0169898 A1* 7/2011 Kato ..... B41J 2/14233 347/71
2012/0098896 A1 4/2012 Nihei
2014/0091678 A1* 4/2014 Koizumi ..... B41J 2/161 310/367
2018/0201018 A1* 7/2018 Mihara ..... B41J 2/14145

FOREIGN PATENT DOCUMENTS

JP 2003-098305 A 4/2003
JP 2012-091380 A 5/2012

* cited by examiner

*Primary Examiner* — Lamson D Nguyen
(74) *Attorney, Agent, or Firm* — Harness, Dickey & Pierce, P.L.C.

(57) ABSTRACT

A nozzle plate is a nozzle plate provided with a plurality of nozzle openings, in which a DLC film is provided on a base material (silicon substrate) of the nozzle plate, the DLC film contains fluorine, a fluorine concentration in the DLC film decreases in a direction from a surface of the DLC film toward the silicon substrate, and a fluorine concentration in a region along the nozzle opening is lower than a fluorine concentration in the surface of the DLC film (surface of flat portion).

7 Claims, 10 Drawing Sheets

NOZZLE PLATE, LIQUID EJECTING HEAD, LIQUID EJECTING APPARATUS, AND MANUFACTURING METHOD OF NOZZLE PLATE

BACKGROUND

1. Technical Field

The present invention relates to a nozzle plate, a liquid ejecting head, a liquid ejecting apparatus, and a manufacturing method of the nozzle plate.

2. Related Art

In the related art, a liquid ejecting head that ejects liquid into liquid droplets has been known as an ink jet type recording head. The liquid ejecting head has a nozzle plate provided with a plurality of nozzle openings, and ejects the liquid droplets toward a recording medium from the nozzle opening. The nozzle plate is required to have liquid repellency to prevent the liquid droplets from adhering to a surface of the nozzle plate. For example, JP-A-2012-91380 discloses a droplet (liquid) ejecting head in which a side of an ejecting surface (liquid ejecting surface) of a nozzle plate is formed with fluorine-containing diamond-like carbon (DLC). As a result, it is disclosed that water repellency can be imparted to the surface of the nozzle plate. In addition, JP-A-2003-98305 also discloses that when fluorine content increases, a hardness of a DLC film itself decreases and does not function as a protective film.

Although the DLC film had high hardness, since the nozzle plate of the liquid ejecting head described in JP-A-2012-91380 contained fluorine in the DLC film in order to obtain the liquid repellency, there was a possibility that the hardness was decreased to cause a problem in durability. The nozzle plate periodically performs maintenance (wiping) to relatively slide a wiper and the liquid ejecting surface of the nozzle plate. In a case of sliding the wiper and the nozzle plate, a large load is applied to an inner peripheral surface (hereinafter referred to as region along the nozzle opening) in the vicinity of the liquid ejecting surface of the nozzle opening from the surface of the nozzle plate. Therefore, for example, in a case where the ink aggregates on the nozzle plate and the hardness of the aggregate is high, there was a problem in abrasion resistance that the region along the nozzle opening is scraped by sliding between the wiper and the nozzle plate during maintenance. On the contrary, in a case where the fluorine content of the DLC film is reduced in order to obtain the abrasion resistance, the liquid repellency of the surface of the DLC film is impaired. That is, it has been difficult to obtain the nozzle plate that is compatible with the durability and the liquid repellency.

SUMMARY

The invention can be realized in the following aspects or application examples.

Application Example 1

According to this application example, there is provided a nozzle plate which is provided with a plurality of nozzle openings, in which a DLC film is provided on a base material of the nozzle plate, the DLC film contains fluorine, a fluorine concentration in the DLC film decreases in a direction from a surface of the DLC film toward the base material, and a fluorine concentration in a region along the nozzle opening is lower than a fluorine concentration in the surface of the DLC film.

In this configuration, the DLC film containing fluorine is provided on the base material of the nozzle plate. The fluorine concentration decreases in the direction from the surface of the DLC film to the base material, and the fluorine concentration in the region along the nozzle opening is lower than that of the fluorine concentration in the surface of the DLC film (nozzle plate surface). As a result, the nozzle plate provided with the fluorine-containing DLC film having high abrasion resistance in the region along the nozzle opening easily scraped by wiping, and having high liquid repellency on the surface of the nozzle plate is realized. Therefore, the nozzle plate having both durability and liquid repellency can be provided.

Application Example 2

According to this application example, there is provided a nozzle plate which is provided with a plurality of nozzle openings, in which a DLC film is provided on a base material of the nozzle plate, the DLC film contains fluorine, and a fluorine concentration gradually decreases from a position where a fluorine concentration between the nozzle openings adjacent to each other shows a maximum value toward the nozzle opening.

In this configuration, the DLC film containing fluorine is provided on the base material of the nozzle plate. The fluorine concentration gradually decreases from the position where the fluorine concentration between the nozzle openings adjacent to each other shows the maximum value toward the nozzle opening. As a result, the nozzle plate provided with the fluorine-containing DLC film having the high abrasion resistance at the nozzle opening easily scraped by wiping, and having the high liquid repellency between nozzle openings has been realized. Therefore, the nozzle plate having both durability and liquid repellency can be provided.

Application Example 3

In the nozzle plate according to the application example, it is preferable that a region having a fluorine concentration lower than that of the region along the nozzle opening be provided between the nozzle openings adjacent to each other.

In this configuration, the region having the fluorine concentration lower than that of the region along the nozzle opening is provided between the nozzle openings adjacent to each other of the nozzle plate. In other words, a region having a lyophilic property higher than that of the region along the nozzle opening is formed between the nozzle openings. Since the liquid (ink) adhered to the nozzle plate is likely to move to the region having the high lyophilic property, the ink accumulated around the nozzle opening is prevented from being drawn into the nozzle opening. As a result, liquid droplets from the nozzle opening can be stably discharged.

Application Example 4

In the nozzle plate according to the application example, it is preferable that a static contact angle of the region along the nozzle opening be 70° or more with respect to $H_2O$.

In this configuration, since the static contact angle of the region along the nozzle opening is 70° or more with respect to $H_2O$, the region along the nozzle opening has the abrasion resistance as well as the liquid repellency. As a result, uneven distribution of a solid matter of the ink in the region along the nozzle opening can be suppressed.

Application Example 5

According to this application example, there is a provided a manufacturing method of a nozzle plate including forming a fluorine-containing DLC film on a base material of the nozzle plate having a nozzle opening, and aging of wiping a surface of the nozzle plate provided with the fluorine-containing DLC film, in which performing of the forming is forming a DLC film of which fluorine concentration decreases in a direction toward the base material, and performing of the aging is scraping the fluorine-containing DLC film, and the DLC film is scraped so that a region along the nozzle opening has a lower fluorine concentration than that of a surface of the fluorine-containing DLC film.

In this configuration, the manufacturing method of the nozzle plate includes the forming the fluorine-containing DLC film on the base material of the nozzle plate having the nozzle opening, and the aging of wiping the surface of the nozzle plate provided with the fluorine-containing DLC film. In the forming, the fluorine-containing DLC film in which the fluorine concentration decreases in the direction from the surface of the DLC film toward the base material is formed. In the aging, the DLC film containing fluorine is scraped. In a case where aging is performed to wipe the surface of the nozzle plate, since the DLC film in the region along the nozzle opening is scraped faster than the DLC film on the surface of the nozzle plate, the fluorine concentration in the surface of the nozzle plate is lower than the fluorine concentration in the region along the nozzle opening. As a result, the fluorine-containing DLC film having the high abrasion resistance in the region along the nozzle opening easily scraped by wiping, and having the high liquid repellency on the surface of the nozzle plate can be formed. Therefore, the manufacturing method of the nozzle plate having both the durability and the liquid repellency can be provided.

Application Example 6

According to this application example, there is a provided a manufacturing method of a nozzle plate including forming a fluorine-containing DLC film on a base material of a nozzle plate having a nozzle opening, defect generating of irradiating between nozzle openings adjacent to each other with laser, and thermal annealing of heating the nozzle plate.

In this configuration, the manufacturing method of the nozzle plate includes the forming the fluorine-containing DLC film on the base material of the nozzle plate having the nozzle opening, the defect generating of irradiating between the nozzle openings adjacent to each other with laser, and the thermal annealing of heating the nozzle plate. When the fluorine-containing DLC film formed in the forming is irradiated with the laser in the defect generating, a defect is generated in that portion. Furthermore, when the nozzle plate is heated in the thermal annealing, fluorine is gathered in a defect portion. In the defect generating, the defect is generated between nozzle openings adjacent to each other, so that the fluorine concentration in the surface of the nozzle plate between the nozzle openings is higher than the fluorine concentration in the region along the nozzle opening. As a result, the fluorine-containing DLC film having the high abrasion resistance in the region along the nozzle opening easily scraped by wiping, and having the high liquid repellency on the surface of the nozzle plate can be formed. Therefore, the manufacturing method of the nozzle plate having both the durability and the liquid repellency can be provided.

Application Example 7

According to this application example, there is a provided a liquid ejecting head including the nozzle plate according to any one of Application Examples 1 to 4.

In this configuration, since the liquid ejecting head includes the nozzle plate according to any one of Application Examples 1 to 4, the liquid ejecting head having both the durability and the liquid repellency can be provided.

Application Example 8

According to this application example, there is a provided a liquid ejecting apparatus including the liquid ejecting head provided with the nozzle plate according to Application Example 7.

In this configuration, since the liquid ejecting apparatus includes the liquid ejecting head according to Application Example 7, the liquid ejecting apparatus good in the durability can be provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the drawings. In the following drawings, in order to make each layer, each member, and the like recognizable size, the scales of each layer, each member, and the like are shown different from the actual scales. In addition, In addition, in FIGS. 2 to 5, two axes or three axes among the X axis, the Y axis, and the Z axis are shown as three axes orthogonal to one another for convenience of explanation.

Embodiment 1

Figure 1:
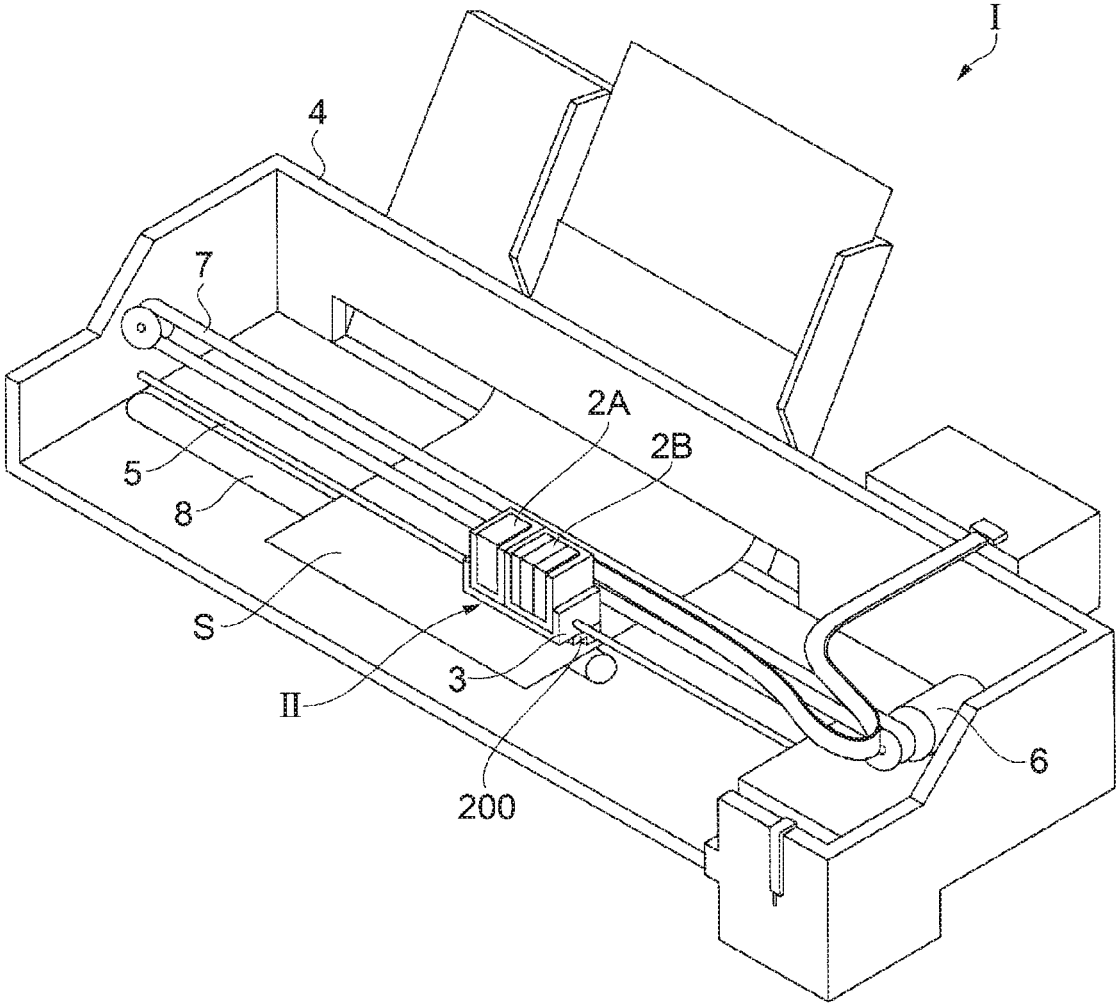
FIG. 1 is a view showing a schematic configuration of a liquid ejecting apparatus according to Embodiment 1.

FIG. 1 is a view showing a schematic configuration of a liquid ejecting apparatus according to Embodiment 1.

As shown in FIG. 1, in the liquid ejecting apparatus I, in a head unit II having a plurality of liquid ejecting heads 200, cartridges 2A and 2B as ink supply means that supplies ink as a liquid to the liquid ejecting head 200 are detachably provided. A carriage 3 on which the head unit II is mounted is provided movably along an axial direction of a carriage shaft 5 attached to an apparatus main body 4. The liquid ejecting head 200 corresponding to the cartridges 2A and 2B ejects, for example, a black ink composition and a color ink composition. The ink supply means may be configured to supply the ink from an ink tank storing the ink with a tube.

A driving force of a drive motor 6 is transmitted to the carriage 3 through a plurality of gears (not shown) and a timing belt 7, so that the head unit II is moved with the carriage 3 along the carriage shaft 5. On the other hand, the apparatus main body 4 is provided with a transport roller 8 as transport means that transports a recording sheet S serving as a recording medium such as paper, and the recording sheet S is transported in a direction intersecting the movement direction of the head unit II by the transport roller 8. The transport means is not limited to the transport roller but may be a belt, a drum, or the like.

Figure 2:
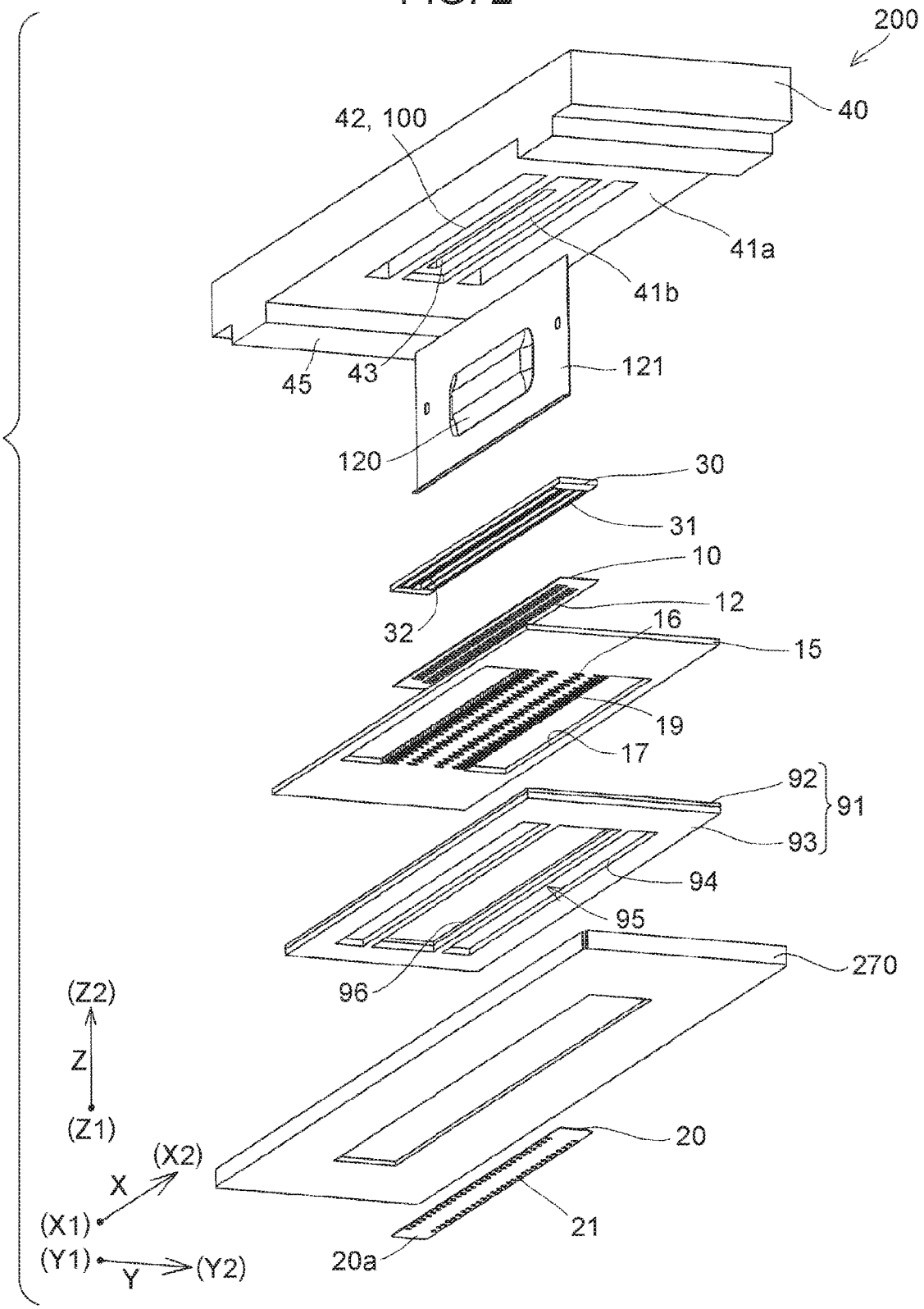
FIG. 2 is an exploded perspective view of a liquid ejecting head.
Figure 3:
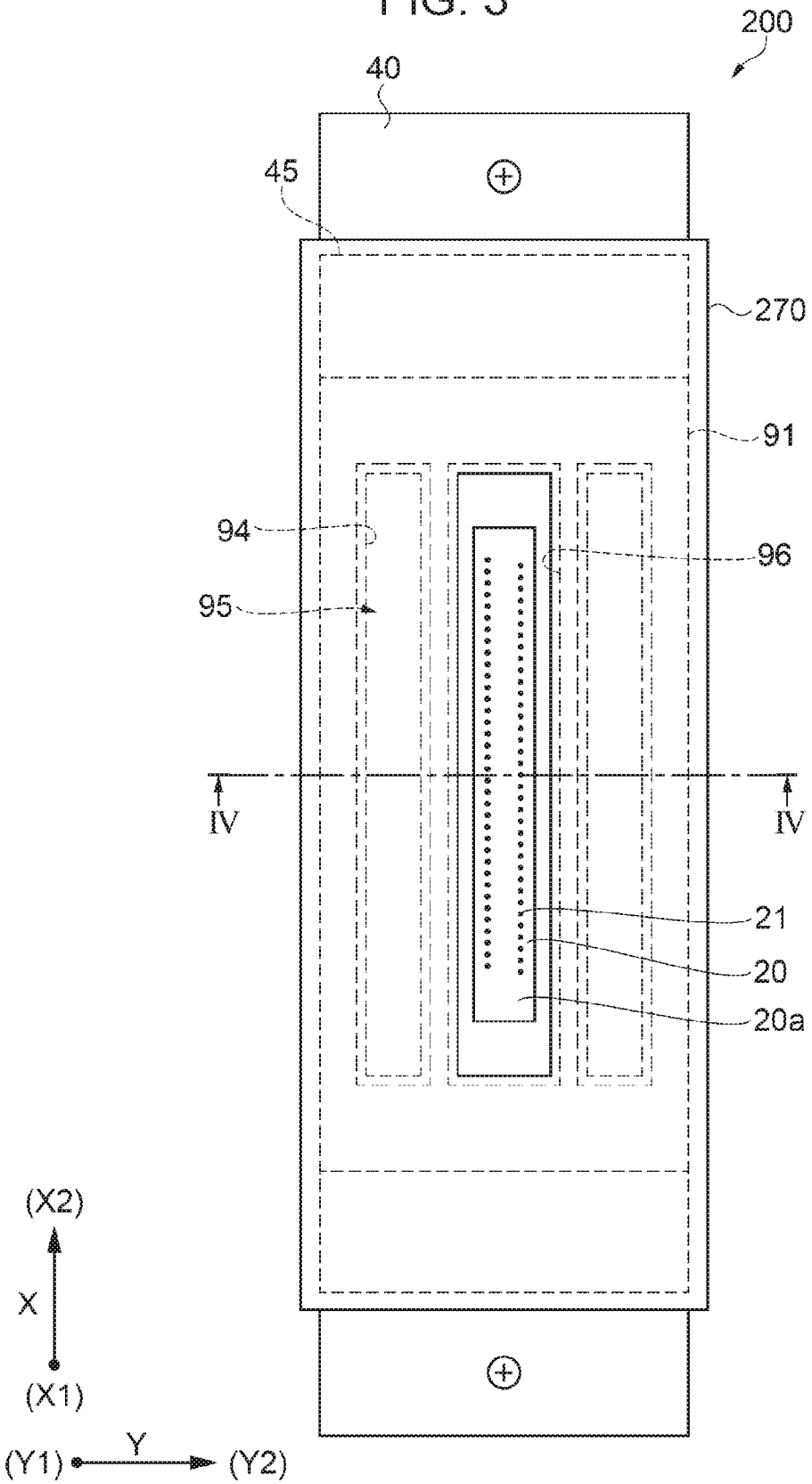
FIG. 3 is a plan view from a side of a liquid ejecting surface of the liquid ejecting head.
Figure 4:
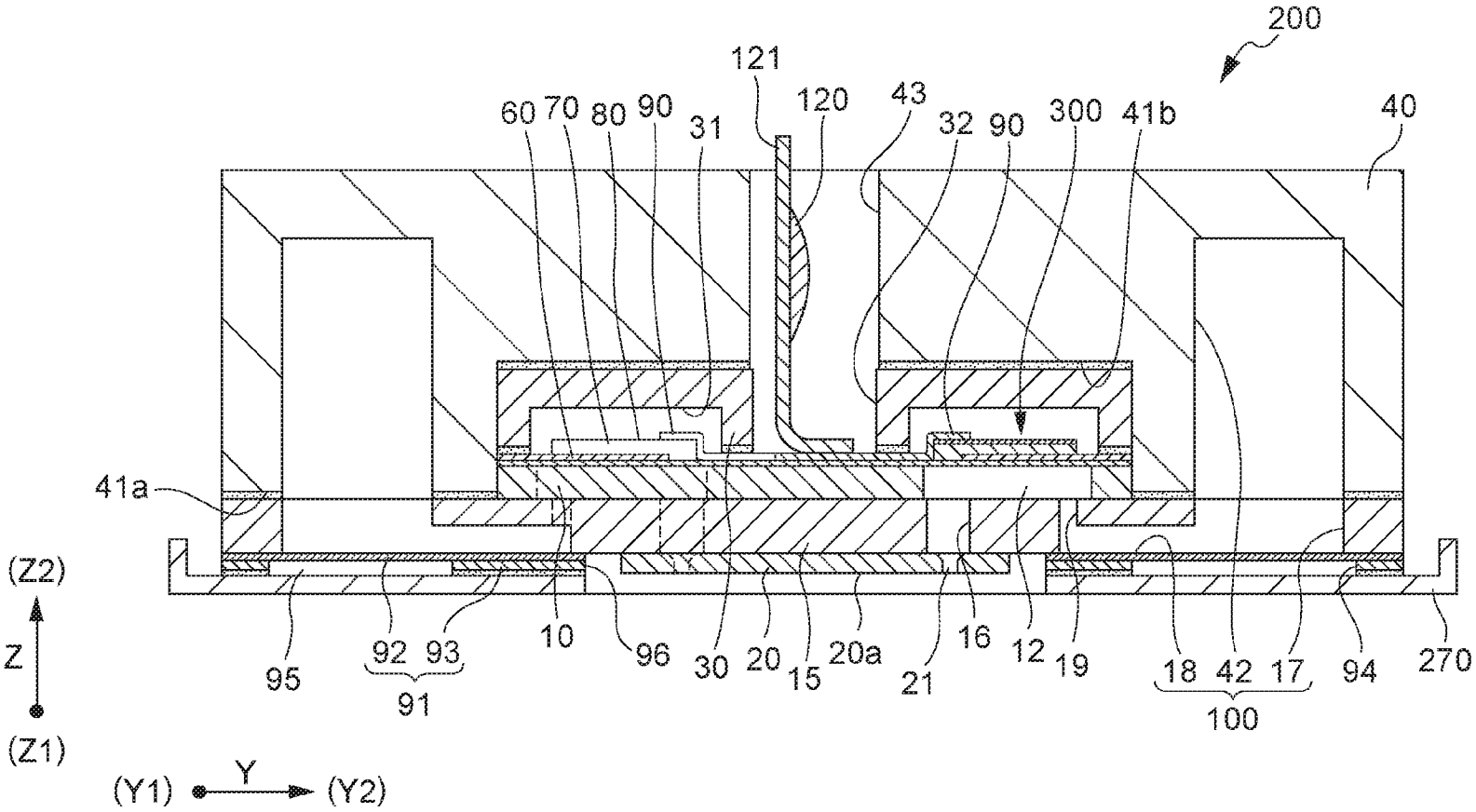
FIG. 4 is a cross-sectional view taken along a line IV-IV in FIG. 3.
Figure 5:
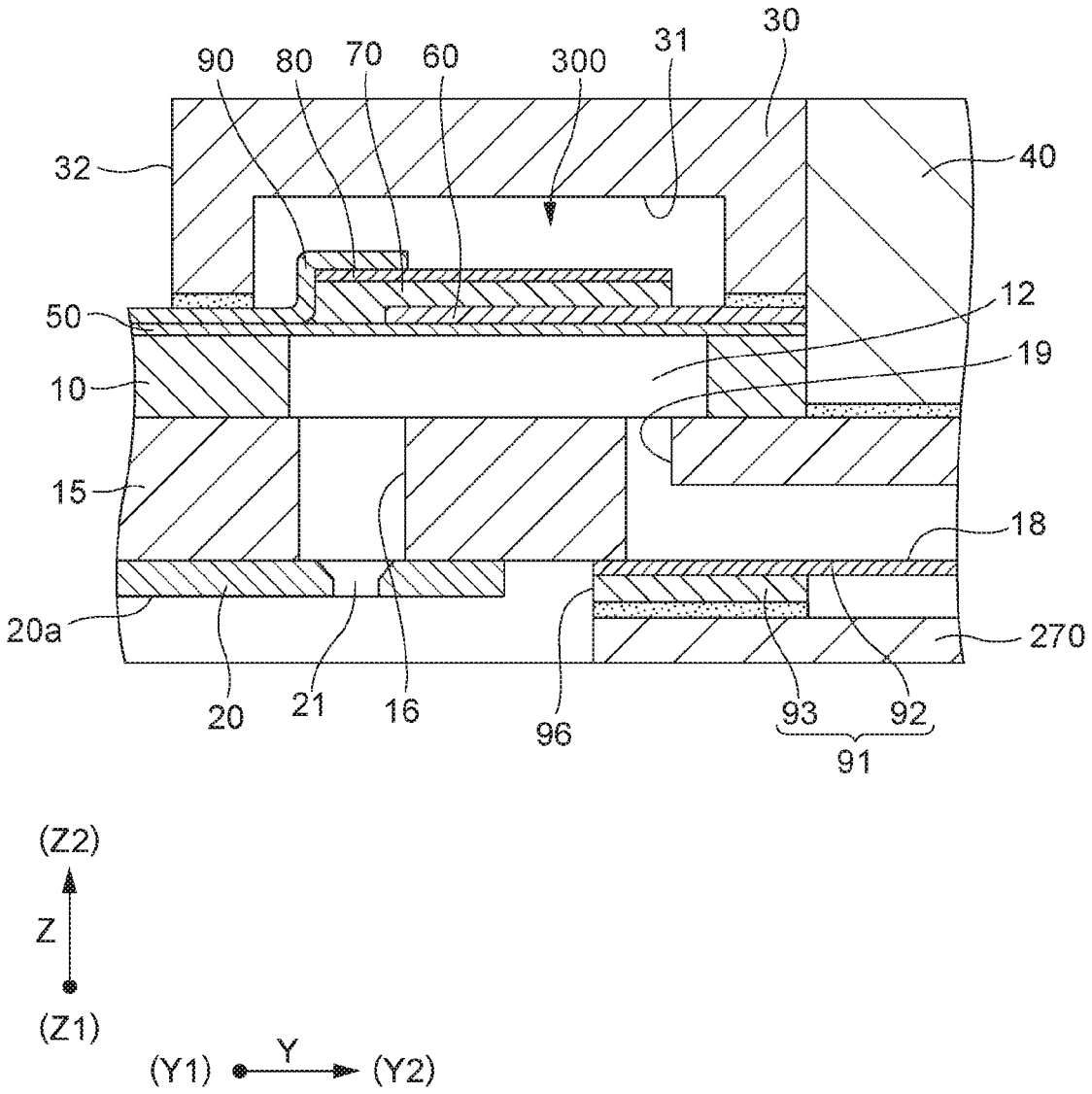
FIG. 5 is a partially enlarged view of FIG. 4.

FIG. 2 is an exploded perspective view of a liquid ejecting head. FIG. 3 is a plan view from a side of a liquid ejecting surface of the liquid ejecting head. FIG. 4 is a cross-sectional view taken along a line IV-IV in FIG. 3. FIG. 5 is a partially enlarged view of FIG. 4. Next, the liquid ejecting head 200 mounted on the head unit II will be described.

As shown in FIGS. 2 to 5, the liquid ejecting head 200 is provided with a plurality of members such as a flow passage forming substrate 10, a communication plate 15, a nozzle plate 20, a protective substrate 30, a case member 40, a compliance substrate 91, and the like. These plurality of members are configured to be joined with an adhesive or the like.

A plurality of pressure generation chambers 12 are disposed in parallel along a direction in which a plurality of nozzle openings 21 are disposed in parallel on the flow passage forming substrate 10 constituting the liquid ejecting head 200. This direction is referred to as a parallel arrangement direction of the pressure generation chamber 12 and coincides with a first direction X. In addition, on the flow passage forming substrate 10, a plurality of rows of pressure generation chambers 12 disposed in parallel in the first direction X are provided, and two rows are provided in this embodiment. The row arrangement direction where a plurality of rows of the pressure generation chambers 12 in which the pressure generation chambers 12 are formed along the first direction X are disposed coincides with a second direction Y.

The two rows where the pressure generation chambers are disposed in parallel in the first direction X are disposed at positions where the row of the other pressure generation chambers 12 is shifted in the first direction X by half of an interval of the pressure generation chambers adjacent to each other in the first direction X with respect to the row of one pressure generation chambers 12. As a result, similarly to the nozzle opening 21 described in detail later, two rows of the nozzle openings 21 are disposed shifted in the first direction X by a half interval to double the resolution in the first direction X. As a matter of course, the positions of the two rows of the pressure generation chambers 12 in the first direction X are set to the same position, so that different inks may be supplied for each row of the pressure generation chambers 12. In addition, in the embodiment, as described above, a direction orthogonal to the first direction X and the second direction Y is referred to as a third direction Z, and in a plane including the third direction Z, a liquid ejecting direction (side of recording sheet S) is a Z1 side and a side opposite thereto is a Z2 side.

The communication plate 15 is joined to a surface on the Z1 side of the flow passage forming substrate 10 in the third direction Z. Furthermore, the nozzle plate 20 having a plurality of the nozzle openings 21 is joined on the Z1 side of the communication plate 15 in the third direction Z. The Z1 side of the nozzle plate 20 in the third direction Z is the liquid ejecting surface 20*a*.

A nozzle communication passage 16 that communicates the pressure generation chamber 12 and the nozzle opening 21 is provided in the communication plate 15. The communication plate 15 has an area larger than that of the flow passage forming substrate 10 and the nozzle plate 20 has an area smaller than that of the flow passage forming substrate 10. In this manner, the area of the nozzle plate is relatively small, so that the cost reduction can be achieved. The area referred to here is an area in the in-plane direction having the first direction X and the second direction Y.

In addition, the communication plate 15 is provided with a first manifold portion 17 and a second manifold portion 18 which constitute a portion of a manifold 100.

The first manifold portion 17 is provided penetrating the communication plate 15 in the third direction Z. In addition, the second manifold portion 18 opens to the side of the nozzle plate 20 of the communication plate 15, that is, the Z1 side in the third direction Z and extends to the middle of the Z2 side, without penetrating the communication plate 15 in the third direction Z.

Furthermore, a supply communication passage 19 communicating with one end portion of the pressure generation chamber 12 in the second direction Y is provided independently for each of the plurality of the pressure generation chambers 12 in the communication plate 15. The supply communication passage 19 penetrates the communication plate 15 in the third direction Z and communicates the second manifold portion 18 and the pressure generation chamber 12.

As shown in FIG. 5, a diaphragm 50 is formed on the side opposite to the communication plate 15 of the flow passage forming substrate 10, that is, on the Z2 side. In addition, a first electrode 60, a piezoelectric layer 70 serving as a driving element, and a second electrode 80 are sequentially laminated on the diaphragm 50, so that a piezoelectric actuator 300 serving as pressure generating means of the embodiment is constituted. In general, any one of the electrodes of the piezoelectric actuator 300 is used as a common electrode, and the other electrode and the piezoelectric layer are patterned for each of the pressure generation chambers 12. In the embodiment, the first electrode 60 is used as the common electrode.

In addition, the protective substrate 30 having substantially the same size as the flow passage forming substrate 10 is joined to the surface of the flow passage forming substrate 10 on the side of the piezoelectric actuator 300, that is, the Z2 side. The protective substrate 30 has a holding portion 31 serving as a space for protecting the piezoelectric actuator 300. Two holding portions 31 are formed side by side in the second direction Y for each row of the piezoelectric actuator 300 disposed in parallel in the first direction X.

As shown in FIG. 4, the protective substrate 30 is provided with a first connection hole 32 penetrating in the third direction Z between two holding portions 31 disposed in parallel in the second direction Y. An end portion of a lead electrode 90 drawn out from an electrode of the piezoelectric actuator 300 is extended so as to be exposed in the first connection hole 32, and the lead electrode 90 and a wiring substrate 121 on which a drive circuit 120 such as a drive IC is mounted are electrically connected in the first connection hole 32. In the embodiment, the flow passage forming substrate 10, the communication plate 15, and the protective substrate 30 correspond to flow passage members. As a matter of course, the flow passage member is not particularly limited thereto, the flow passage forming substrate 10 may be formed with a size corresponding to the communication plate 15 without providing the communication plate 15 as the flow passage member, and other members may be provided as the flow passage member.

In addition, as shown in FIGS. 2, 4, and 5, the case member 40 that defines the manifold 100 communicating with the plurality of the pressure generation chambers 12, together with the flow passage forming substrate 10, and the protective substrate 30 is fixed to the protective substrate 30 and the communication plate 15. The case member 40 is joined to the protective substrate 30 and joined to the communication plate 15. Specifically, the case member 40 has a first accommodating portion 41*a* that opens to the surface on the Z1 side and has a recessed shape of a depth accommodating the communication plate 15. In addition, the first accommodating portion 41*a* is provided to be opened to the side surface in the second direction Y. That is, a foot portion 45 protruding toward the Z1 side is provided on both sides in the first direction X of the first accommodating portion 41*a*, and the tip end surface of the foot portion 45 on the Z1 side is joined to a cover head 270 described later. Such a first accommodating portion 41*a* is formed with an opening slightly larger than that of the communication plate 15 so that the communication plate 15 can be inserted.

In addition, a second accommodating portion 41*b* having a recessed shape with a depth accommodating the flow passage forming substrate 10 and the protective substrate 30 is provided on a bottom surface of the first accommodating portion 41*a*, that is, on a surface of the case member 40 on the Z1 side. The second accommodating portion 41*b* has a slightly wider opening area than a surface of the protective substrate 30 on the Z2 side. The flow passage forming substrate 10 and the protective substrate 30 are accommodated in the second accommodating portion 41*b*, and the opening of the second accommodating portion 41*b* on the Z1 side is sealed by the communication plate 15.

In addition, a third manifold portion 42 having a recessed shape opening to the surface on the Z1 side is formed on the bottom surface of the first accommodating portion 41*a*, that is, on the surface of the case member 40 on the Z1 side. The second accommodating portion 41*b* and the third manifold portion 42 are partitioned without communicating by joining the communication plate 15 to the opening surface thereof. the manifold 100 of the embodiment is configured to include the third manifold portion 42 formed in the case member 40, and the first manifold portion and the second manifold portion 18 provided in the communication plate 15. In the embodiment, the manifolds 100 are formed on both sides across the second direction Y of the flow passage forming substrate 10. As a matter of course, the manifold 100 is not limited thereto, for example, the manifold 100 may configured to include only the third manifold portion 42, and may configured to include the second manifold portion 18 and the third manifold portion 42. However, the manifold 100 is configured to include the first manifold portion 17, the second manifold portion 18, and the third manifold portion 42 as in the embodiment, the manifold 100 with a volume as large as possible can be formed without increasing the size of the liquid ejecting head 200.

The flow passage forming substrate 10 and the protective substrate 30 are adhered to the case member 40 with an adhesive in the second accommodating portion 41*b*. In addition, the communication plate 15 and the surface on the Z1 side serving as the bottom surface of the first accommodating portion 41*a* of the case member 40 are adhered by the adhesive. The communication plate 15 and the case member 40 are adhered to each other with the adhesive in this manner, so that it is prevented the ink in the manifold 100 from flowing out from between the communication plate 15 and the case member 40 to the inside or the outside of the second accommodating portion 41*b*.

In addition, the case member 40 is provided with a second connection hole 43 which communicates with the first connection hole 32 of the protective substrate 30 and penetrates the case member 40 in the third direction Z. The circuit board substrate 121 inserted through the second connection hole 43 is inserted into the first connection hole 32 and connected to the lead electrode 90 serving as a lead-out wire drawn out from the piezoelectric actuator 300.

Furthermore, although not specifically shown, the case member 40 is provided with an inflow passage that supplies the ink to the manifold 100 and an outflow passage that flow out the ink in the manifold 100. For example, the inflow passage may be provided on the X1 side serving as one side in the first direction X, and the outflow passage may be provided on the X2 side serving as the other side in the first direction X.

In addition, a compliance substrate 91 is provided on a surface of the communication plate 15 on which the first manifold portion 17 and the second manifold portion 18 open. The compliance substrate 91 seals the openings of the first manifold portion 17 and the second manifold portion 18. That is, the flow passages of the flow passage member configured to include the flow passage forming substrate 10, the communication plate 15, and the protective substrate 30 of the embodiment are the first manifold portion 17 and the second manifold portion 18, and the compliance substrate 91 seals the Z1 side serving as the side of the liquid ejecting surface 20*a* of the first manifold portion 17 and the second manifold portion 18.

In the embodiment, such a compliance substrate 91 includes a sealing film 92 and a fixed substrate 93. The sealing film 92 is formed of a thin film having flexibility (for example, polyphenylene sulfide (PPS), stainless steel (SUS), or the like). In addition, the fixed substrate 93 is formed of a hard material such as metal such as stainless steel (SUS). Since a region of the fixed substrate 93 facing the manifold 100 is the opening portion 94 completely removed in the thickness direction, one surface of the manifold 100 is a compliance portion 95 serving as a flexible portion sealed only by a flexible sealing film 92.

The compliance substrate 91 is provided continuously around the periphery of the nozzle plate 20. That is, on the compliance substrate 91, a first exposure opening portion 96 having an inner diameter slightly larger than that of the nozzle plate 20 is provided in a region where the nozzle plate 20 is disposed.

A cover head 270 protecting the nozzle opening 21 in a state of exposing the nozzle opening 21 is fixed to the side of the liquid ejecting surface 20*a* where the nozzle opening 21 of such a liquid ejecting head 200 opens.

Here, the protective substrate 30 is formed of a material having conductivity, stainless steel (SUS) in this embodiment, and is electrically connected to the above-described first electrode 60.

In such a liquid ejecting head 200, when the ink is ejected, the inside of the flow passage from the manifold 100 to the nozzle opening 21 is filled with the ink. Thereafter, according to a signal from the drive circuit 120, a voltage is applied to the piezoelectric actuator 300 corresponding to each pressure generation chamber 12, thereby causing the diaphragm 50 to deform together with the piezoelectric actuator 300. As a result, the pressure in the pressure generation chamber 12 increases and liquid droplets are ejected from the predetermined nozzle opening 21.

In the embodiment, the configuration using the thin film type piezoelectric actuator 300 as pressure generating means that causes the pressure change in the pressure generation chamber 12 is exemplified, but the invention is not limited thereto. For example, as the pressure generating means, a device in which a heating element is disposed in a pressure chamber and liquid droplets are discharged from the nozzle opening by bubbles generated by heat generation of the heating element, or a so-called electrostatic actuator which generates static electricity between the diaphragm and the electrode and deforms the diaphragm by the electrostatic force to discharge the liquid droplets from the nozzle opening, or the like can be used.

Figure 6:
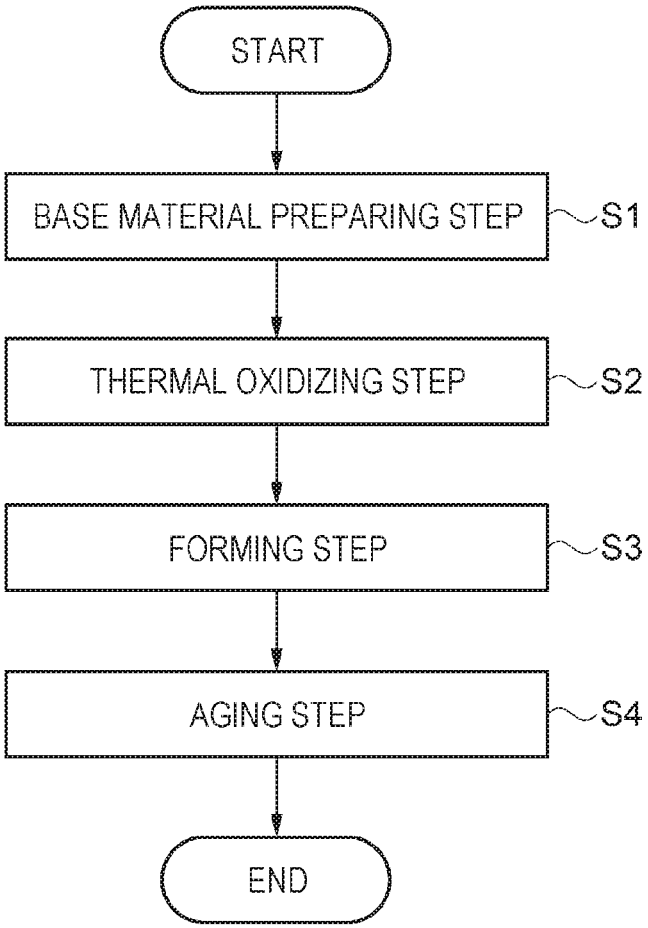
FIG. 6 is a flowchart diagram describing a manufacturing method of a nozzle plate.

FIG. 6 is a flowchart diagram describing a manufacturing method of a nozzle plate. FIGS. 7A to 7E are cross-sectional views partially enlarging the nozzle plate. First, the manufacturing method of the nozzle plate 20 will be described with reference to FIGS. 6, and 7A to 7E. In FIGS. 7A to 7E, the liquid ejecting direction (Z1 side) is shown in reverse to FIGS. 4 and 5.

Figure 7A:
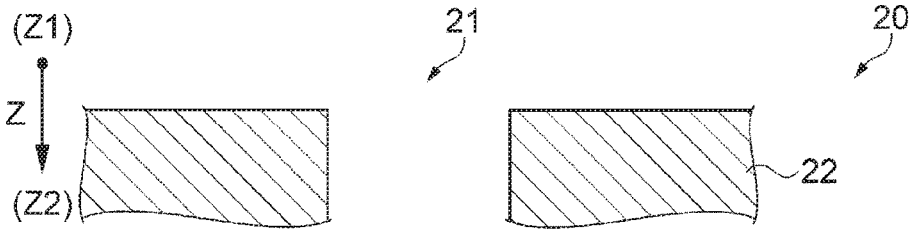
FIG. 7A is a cross-sectional view partially enlarging the nozzle plate.

Step S1 is a base material preparing step of preparing a base material serving as the nozzle plate 20. As a substrate material (base material) of the nozzle plate 20, a silicon single crystal substrate (silicon substrate) can be used. A plurality of the nozzle plates 20 are produced from the silicon substrate 22. By dry etching this silicon substrate 22, a cylindrical nozzle opening 21 is formed as shown in FIG. 7A.

Figure 7B:
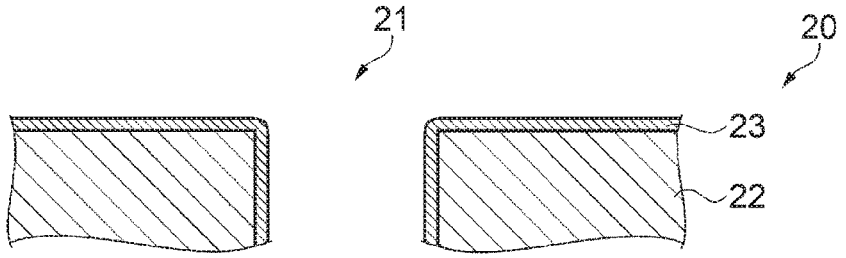
FIG. 7B is a cross-sectional view partially enlarging the nozzle plate.

Step S2 is a thermal oxidizing step of forming an oxide film on the silicon substrate 22. By subjecting the silicon substrate 22 to heat treatment, a silicon thermal oxide film 23 is formed on both surfaces of the silicon substrate 22 and on an inner peripheral surface of the nozzle opening 21 as shown in FIG. 7B. The thermal oxide film 23 is made of silicon dioxide and the thickness thereof is approximately 100 nm. By performing thermal oxidation at a high temperature, a thick, dense and stable film can be formed. The thermal oxidation step may be omitted. At that time, a natural oxide film having a thin thickness is formed.

Figure 7C:
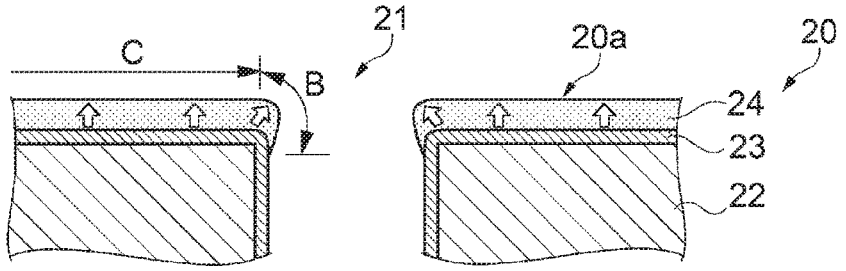
FIG. 7C is a cross-sectional view partially enlarging the nozzle plate.

Step S3 is a forming step of a fluorine-containing DLC film 24 on the base material (silicon substrate 22) of the nozzle plate 20. The DLC film 24 is provided on the silicon substrate 22 of the nozzle plate 20, and the DLC film 24 contains fluorine (hereinafter referred to as a fluorine-containing DLC film 24). The fluorine-containing DLC film 24 is formed by a chemical vapor deposition (CVD) method. In a case of forming the fluorine-containing DLC film 24 by the CVD method, fluorohydrogenated amorphous carbon or fluorinated carbon such as $C_4F_8$, $C_3F_6$, and $C_2F_6$ can be used as a raw material gas. By exposing the silicon substrate 22 to a glow discharge plasma of these source gases, the fluorine-containing DLC film 24 is formed on the side of the liquid ejecting surface 20*a* where the nozzle opening 21 opens as a liquid repellent film as shown in FIG. 7C. At this time, the fluorine-containing DLC film 24 is also formed on the inner peripheral surface (region B along the nozzle opening 21) in the vicinity of the liquid ejecting surface 20*a* of the nozzle opening 21 indicated by "B" in FIG. 7C.

The film forming step is a step of forming the DLC film 24 in which a fluorine concentration decreases in the direction toward the base material (side of silicon substrate 22). In the embodiment, the fluorine content in the DLC film is changed by gradually increasing the flow rate of the source gas during film formation. As a result, the fluorine-containing DLC in which the fluorine content in the DLC film 24 decreases in the direction from the surface of the DLC film 24 toward the side of the silicon substrate is formed. The DLC film 24 changes from a composition having a high liquid repellency to a composition having a high abrasion resistance from the surface toward the side of the silicon substrate 22. In the region B along the nozzle opening 21, the fluorine concentration becomes higher toward the outer peripheral edge of the arc shape. In FIG. 7C, a direction in which the fluorine concentration is increased is indicated by an arrow. The thickness of the fluorine-containing DLC film 24 is preferably in the range of 20 nm or more and 100 nm or less.

Figure 7D:
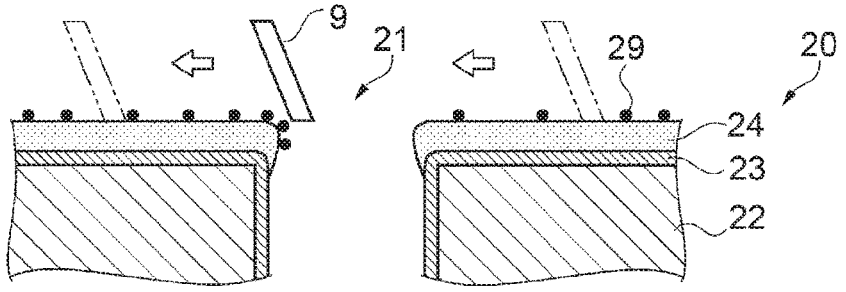
FIG. 7D is a cross-sectional view partially enlarging the nozzle plate.

Step S4 is an aging step of wiping the surface (liquid ejecting surface 20*a*) of the nozzle plate 20 on which the fluorine-containing DLC film 24 is provided. This aging step is a step of scraping the fluorine-containing DLC film 24, and the fluorine-containing DLC film 24 is scraped so that the region B along the nozzle opening 21 has a fluorine concentration lower than that of the surface of the fluorine-containing DLC film 24 (surface of the flat portion C). As shown in FIG. 7D, the liquid ejecting surface 20*a* of the nozzle plate 20 is repeatedly slid by a predetermined load using a wiper 9 when wiping the nozzle plate in a state where an abrasive 29 is applied. As a result, the fluorine-containing DLC film 24 formed on the nozzle plate 20 is polished (abraded). In the embodiment, as the abrasive 29, a material obtained by adding a solvent to titanium oxide ($TiO_2$) is used.

Figure 7E:
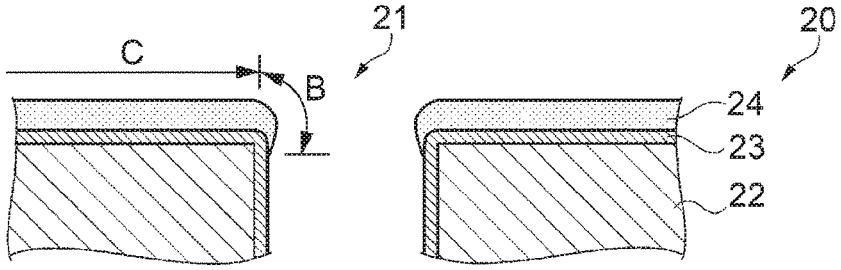
FIG. 7E is a cross-sectional view partially enlarging the nozzle plate.

Titanium oxide is a material contained in the ink and is also a causal substance that abrades the nozzle plate by wiping that periodically maintains the nozzle plate 20. The wiper 9 is formed of a flexible elastomer or the like. When the wiper 9 is slid with respect to the nozzle plate 20, the tip end of the wiper 9 enters the region B along the nozzle opening 21 due to the flexibility, so that since a larger load is applied to the region B than to the flat portion C, the DLC film 24 in the region B along the nozzle opening 21 is polished faster than the flat portion C as shown in FIG. 7E. The DLC film 24 having a fluorine concentration lower than that of the flat portion C appears by this polishing in the region B along the nozzle opening 21.

A nozzle shape of the region B along the nozzle opening 21 formed at this time can be controlled by the film thickness of the fluorine-containing DLC film 24 formed in the film forming step. For example, in a case where a fluorine-containing DLC film 24 with a thin film thickness with a sharp change in fluorine concentration is formed, a nozzle opening 21 having a small R (radius) shape in the region B is formed, and on the contrary, in a case where a fluorine-containing DLC film 24 having a thick film thickness with a gradual change in the fluorine concentration is formed, a nozzle opening 21 having a large R shape in the region B is formed.

Through the above steps, as shown in FIG. 7E, the nozzle plate 20 in which the DLC film 24 having the low fluorine concentration and high abrasion resistance is formed in the region B along the nozzle opening 21 having a high polishing rate, and the DLC film 24 having the high fluorine concentration and the high liquid repellency is formed on the flat portion C having a low polishing rate can be obtained.

Next, the nozzle plate 20 formed by the above steps will be described with reference to FIG. 7E.

The nozzle plate 20 has the fluorine-containing DLC film 24 of which fluorine concentration in the region B along the nozzle opening 21 is lower than the fluorine concentration of the surface (flat portion C) of the DLC film 24. In other words, it can be said that the fluorine-containing DLC film 24 of the nozzle plate 20 gradually decreases in fluorine concentration from a position where the fluorine concentration between the nozzle openings 21 adjacent to each other exhibits the maximum value toward the nozzle opening 21. As a result, the nozzle plate provided with the fluorine-containing DLC film 24 having the high abrasion resistance in the region B along the nozzle opening and having the high liquid repellency on the surface (flat portion C) of the nozzle plate 20 is realized.

In addition, the DLC film 24 in the region B along the nozzle opening 21 has a static contact angle of 70° or more with respect to $H_2O$. This is because, a layer of the fluorine-containing DLC film 24 having Vickers hardness of approximately 10 GPa which does not scrape out with respect to a hardness of the titanium oxide appears by performing the aging step in the region B along the nozzle opening 21. The static contact angle of the film is 70° or more with respect to $H_2O$. As a result, since the region B along the nozzle opening 21 has good abrasion resistance as well as liquid repellency, uneven distribution such as a solid matter of ink in the region B along the nozzle opening 21 can be suppressed.

In the present embodiment, although the fluorine-containing DLC film 24 is formed by the CVD method, other film forming methods may be used. For example, in the case of using a sputtering method, a reaction gas containing fluorine (F) is introduced into a chamber by using DLC as a target to form a film. By increasing the flow rate of the reaction gas (F) during film formation, a fluorine-containing DLC film of which fluorine content in the DLC film decreases in the direction from the surface of the DLC film toward the side of the silicon substrate 22 can be formed. In addition, a laminated film in which a DLC film having a fluorine content gradually increased is sequentially formed may be used.

As described above, according to the manufacturing method according of the nozzle plate 20, the liquid ejecting head 200, the liquid ejecting apparatus I, and the nozzle plate according to the embodiment, the following effects can be obtained.

In the nozzle plate 20, the fluorine concentration decreases in the direction from the surface of the DLC film toward the silicon substrate 22, and the fluorine-containing DLC film 24 having the lower fluorine concentration in the region B along the nozzle opening 21 than the fluorine concentration of the surface (flat portion C) of the DLC film 24 is provided. In other words, it can be said that the fluorine-containing DLC film 24 of the nozzle plate 20 gradually decreases in fluorine concentration from the position where the fluorine concentration between the nozzle openings 21 adjacent to each other exhibits the maximum value toward the nozzle opening 21. As a result, the nozzle plate 20 provided with the fluorine-containing DLC film 24 having the high abrasion resistance in the region B along the nozzle opening 21 and having the high liquid repellency on the surface (flat portion C) of the nozzle plate 20 is realized. Therefore, the nozzle plate 20 having both the durability and the liquid repellency can be provided.

The DLC film 24 in the region B along the nozzle opening 21 has a static contact angle of 70° or more with respect to $H_2O$. As a result, since the region B along the nozzle opening 21 has good abrasion resistance as well as liquid repellency, uneven distribution such as a solid matter of ink in the region B along the nozzle opening 21 can be suppressed.

The manufacturing method of the nozzle plate 20 has the film forming step that forms the fluorine-containing DLC film 24 on the base material (silicon substrate 22) of the nozzle plate, and the aging step that wipes the surface of the nozzle plate 20 (liquid ejecting surface 20*a*) provided with the fluorine-containing DLC film 24. The fluorine-containing DLC film of which fluorine content in the DLC film 24 decreases in the direction from the surface of the DLC film 24 toward the side of the silicon substrate 22 is formed by the film forming step. In the aging step, the DLC film 24 in the region B along the nozzle opening 21 is polished faster than the flat portion C of the nozzle plate 20. The layer of the DLC film 24 having a fluorine concentration lower than that of the flat portion C appears by this polishing in the region B along the nozzle opening 21. As a result, the nozzle plate 20 in which the DLC film 24 having the low fluorine concentration and high abrasion resistance is formed in the region B along the nozzle opening 21 easily scraped by wiping, and the DLC film 24 having the high fluorine concentration and the high liquid repellency is formed on the flat portion C can be obtained. Therefore, the manufacturing method of the nozzle plate 20 having both the durability and the liquid repellency can be provided.

The liquid ejecting head 200 is provided with the nozzle plate 20 having the high abrasion resistance in the region B along the nozzle opening 21 and the high liquid repellency in the flat portion C. As a result, the liquid ejecting head 200 having both the durability and the liquid repellency can be provided.

The liquid ejecting apparatus I is provided with the liquid ejecting head 200 including the nozzle plate 20 having the high abrasion resistance in the region B along the nozzle opening 21 and the high liquid repellency in the flat portion C. As a result, the liquid ejecting apparatus I having good durability can be provided.

Embodiment 2

Figure 8:
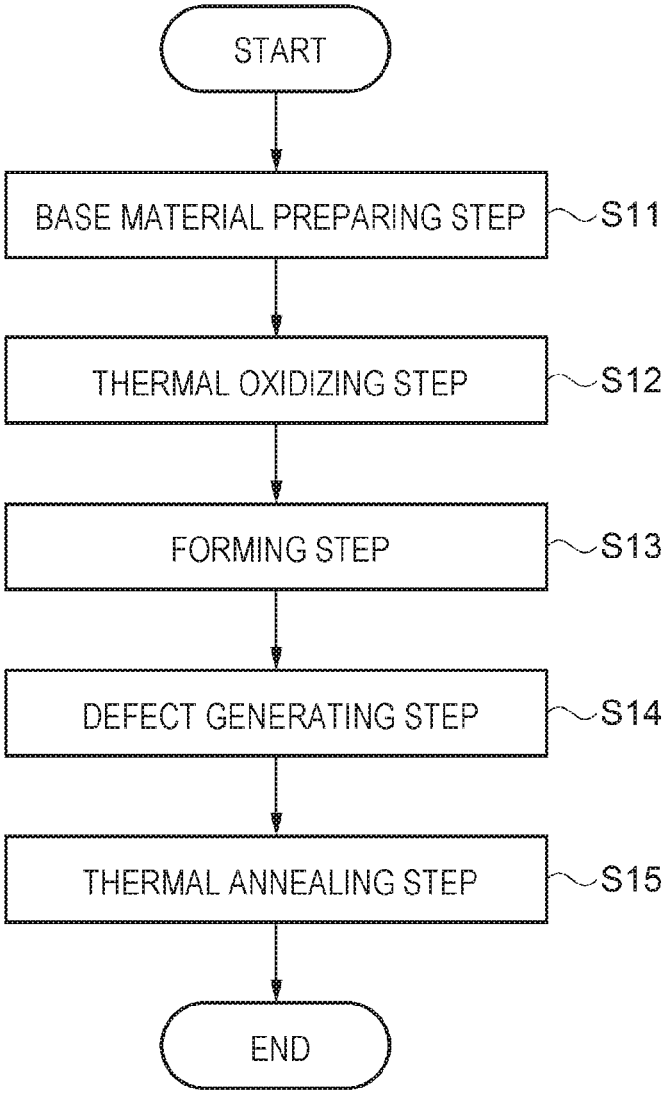
FIG. 8 is a flowchart describing a manufacturing method of a nozzle plate according to Embodiment 2.
Figure 9A:
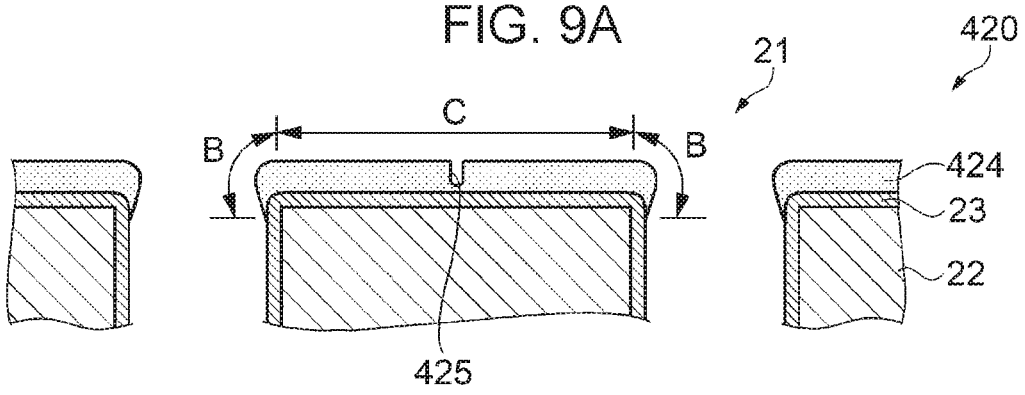
FIG. 9A is a cross-sectional view partially enlarging the nozzle plate.
Figure 9B:
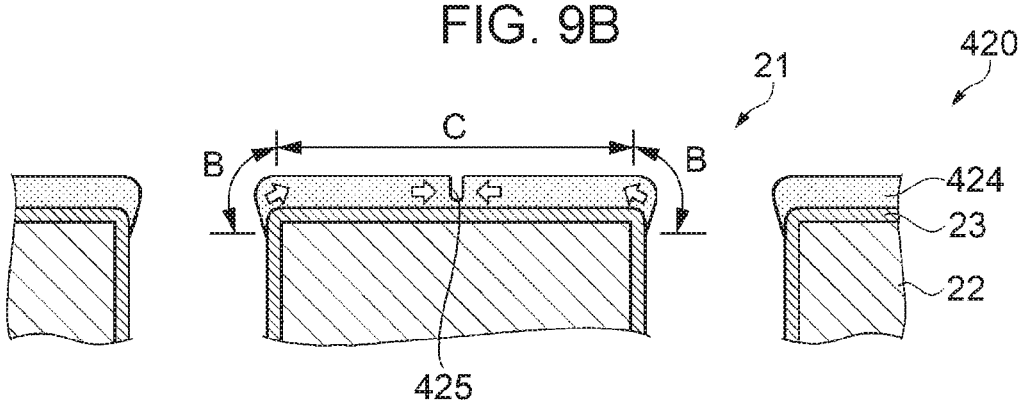
FIG. 9B is a cross-sectional view partially enlarging the nozzle plate.
Figure 10:
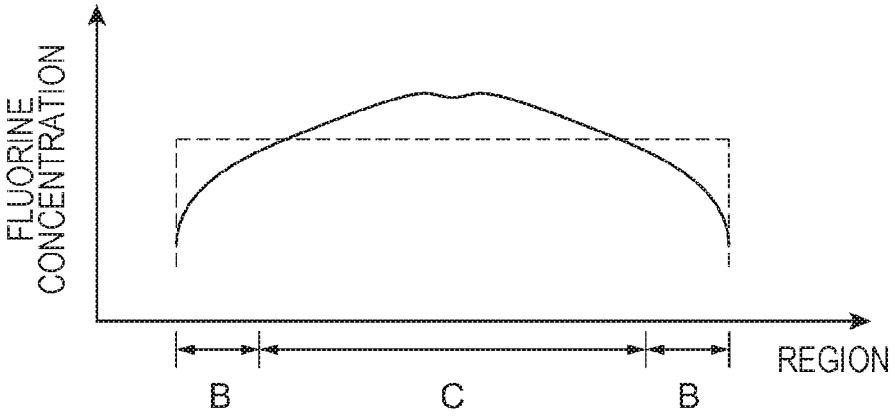
FIG. 10 is a graph showing a distribution of a fluorine concentration in a surface of a DLC film.

FIG. 8 is a flowchart describing a manufacturing method of a nozzle plate according to Embodiment 2. FIGS. 9A and 9B are cross-sectional views partially enlarging the nozzle plate. FIG. 10 is a graph showing a distribution of a fluorine concentration in a surface of a DLC film. A manufacturing method different from that of Embodiment 1 of the nozzle plate 420 will be described with reference to FIGS. 8 to 10.

The same constituent parts as those of Embodiment 1 are used by the same reference numerals, and redundant descriptions will be omitted. In addition, since steps S11 and S12 are the same as steps S1 and S2 described in Embodiment 1, description thereof will be omitted.

Step S13 is a forming step of a fluorine-containing DLC film 424 on a base material (silicon substrate 22) of a nozzle plate 420. In this embodiment, the fluorine-containing DLC film 424 containing a uniform fluorine concentration is formed. The fluorine-containing DLC film 424 can be formed by a CVD method, a sputtering method, or the like.

Step S14 is a defect generating step of irradiating between the nozzle openings 21 adjacent to each other with a laser. As shown in FIG. 9A, by irradiating between the nozzle openings 21 with a laser beam, a defect portion 425 in which the fluorine-containing DLC film 424 disappears in the depth direction is generated. As the types of laser light source, $CO_2$ laser, fiber laser, YAG laser, or the like can be used. For example, the fluorine-containing DLC film 424 is irradiated with the laser through a mask having openings between nozzle openings 21 adjacent to each other, so that the defect portion 425 is formed between the nozzle openings 21.

Step S15 is a thermal annealing step of heating the nozzle plate 420. The nozzle plate 420 in which the defect portion 425 is formed between the nozzle openings 21 adjacent to each other is subjected to thermal annealing at a temperature of approximately 400° C., so that the fluorine component contained in the DLC film 424 moves in the direction of the defect portion 425. In FIG. 9B, the direction where the fluorine component moves is indicated by an arrow. FIG. 10 is a graph showing the distribution of the fluorine concentration corresponding to the region B along one nozzle opening 21, the flat portion C, and the region B along the other nozzle opening 21, a broken line shows the outline of the fluorine concentration distribution before the thermal annealing, and a solid line shows the outline of the fluorine concentration distribution after the thermal annealing. The fluorine component moves to the side of the defect portion 425 by the thermal annealing step, so that as indicated by the solid line in FIG. 10, the DLC film 424 having a fluorine concentration in the flat portion C higher than that in the region B along the nozzle opening 21 is formed. As a result, the nozzle plate 420 in which the DLC film 424 having the low fluorine concentration and high abrasion resistance is formed in the region B along the nozzle opening 21 easily scraped by wiping, and the DLC film 424 having the high fluorine concentration and the high liquid repellency is formed on the flat portion C can be obtained.

As described above, according to the manufacturing method of the nozzle plate according to the embodiment, the following effects can be obtained.

The manufacturing method of the nozzle plate 420 has the film forming step that forms the fluorine-containing DLC film 424 on the base material (silicon substrate 22) of the nozzle plate 420, and the defect generation step of irradiating between the nozzle openings 21 adjacent to each other with a laser, and the thermal annealing step of heating the nozzle plate 420. The fluorine-containing DLC film 424 having a uniform fluorine concentration is formed in the film forming step, and the defect portion 425 is formed between the nozzle openings 21 in the defect generation step. Furthermore, the nozzle plate 420 is subjected to thermal annealing in the thermal annealing step, so that since the fluorine component contained moves to the defect portion 425, the DLC film 424 having the higher fluorine concentration is formed in the flat portion C than in the region B along the nozzle opening 21. As a result, the nozzle plate 420 in which the DLC film 424 having the low fluorine concentration and high abrasion resistance is formed in the region B along the nozzle opening 21 easily scraped by wiping, and the DLC film 424 having the high fluorine concentration and the high liquid repellency is formed on the flat portion C can be obtained. Therefore, the manufacturing method of the nozzle plate 420 having both the durability and the liquid repellency can be provided.

The invention is not limited to the above-described embodiments, and various modifications and improvements can be added to the above-described embodiments. Modification examples will be described below.

Modification Example 1

Figure 11:
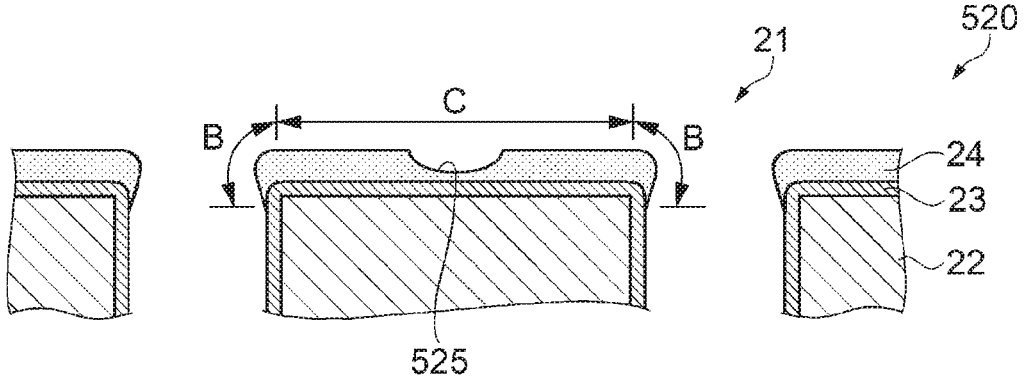
FIG. 11 is a cross-sectional view partially enlarging a nozzle plate according to Modification Example 1.

FIG. 11 is a cross-sectional view partially enlarging a nozzle plate according to Modification Example 1. A configuration of a nozzle plate 520 will be described with reference to FIG. 11. The same constituent parts as those of Embodiment 1 are denoted by the same reference numerals, and redundant descriptions will be omitted.

In the nozzle plate 520, a region 525 having a fluorine concentration lower than that of the region B along the nozzle opening 21 is provided between the nozzle openings 21 adjacent to each other. In the nozzle plate 520 shown in this modification example, the region 525 having a low fluorine concentration is formed in the nozzle plate 20 described in Embodiment 1. As shown in FIG. 11, the region 525 having a thin film thickness of the fluorine-containing DLC film 24 is formed between the nozzle openings 21 adjacent to each other. Since the fluorine concentration of the fluorine-containing DLC film 24 is decreased in the direction from the surface of the DLC film 24 toward the side of the silicon substrate 22, by causing the film thickness of the region 525 thinner than the film thickness of the region B along the nozzle opening 21, it is possible to configure the region 525 having a fluorine concentration lower than that of the region B along the nozzle opening 21. In the modification example, the fluorine-containing DLC film 24 is irradiated with a laser through a mask having openings between the nozzle openings 21 adjacent to each other, so that the region 525 having a small film thickness (low fluorine concentration) is formed between the nozzle openings 21.

The region 525 having a fluorine concentration lower than that of the region B along the nozzle opening 21 has lyophilic property higher than that of the region B. In addition, the ink adhered to the nozzle plate 520 is likely to move from a region with high liquid repellency to a region with high lyophilic property. Since the region 525 having a lyophilic property higher than that of the region B along the nozzle opening 21 is formed between the nozzle openings 21 of this modification example, the ink adhering from the region B to the region 525 is prevented from being drawn into the nozzle opening 21. As a result, liquid droplets from the nozzle opening 21 can be stably discharged.

Modification Example 2

Figure 12:
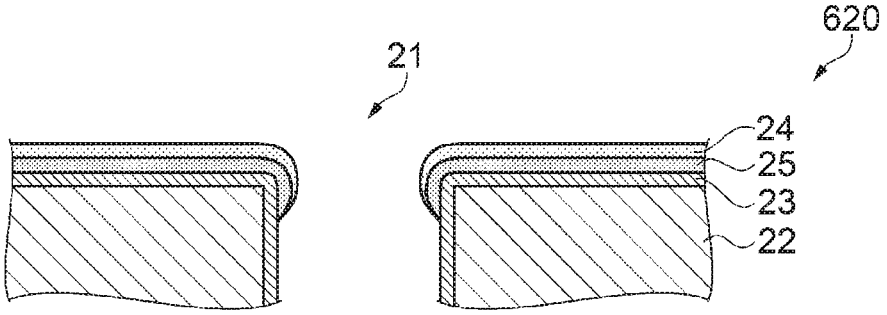
FIG. 12 is a cross-sectional view partially enlarging a nozzle plate according to Modification Example 2.

FIG. 12 is a cross-sectional view partially enlarging a nozzle plate according to Modification Example 2. A configuration of a nozzle plate 620 will be described with reference to FIG. 12. The same constituent parts as those of Embodiment 1 are denoted by the same reference numerals, and redundant descriptions will be omitted.

As shown in FIG. 12, in the nozzle plate 620, a DLC film 25 not containing fluorine is formed on a thermal oxide film 23, and a fluorine-containing DLC film 24 is further formed thereon. As a result, the film thickness of the fluorine-containing DLC film 24 can be reduced while ensuring the necessary thickness as the protective film of the nozzle plate 620. As a result, since the amount of scraping the fluorine-containing DLC film 24 in the aging step described in Embodiment 1 is reduced, the working efficiency in the aging step can be improved. Furthermore, it is possible to prevent the R shape in the region B along the nozzle opening 21 from being larger than necessary.

The entire disclosure of Japanese Patent Application No. 2017-123993, filed Jun. 26, 2017 is expressly incorporated by reference herein.

What is claimed is:

1. A nozzle plate having a plurality of nozzle openings, the nozzle plate comprising:

a base; and a diamond-like carbon film on the base, wherein the diamond-like carbon film contains fluorine, a fluorine concentration in the diamond-like carbon film decreases from a surface of the diamond-like carbon film toward the base, a lip of each nozzle opening has a first fluorine concentration, the surface of the diamond-like carbon film has a second fluorine concentration, and the first fluorine concentration is lower than the second fluorine concentration.

2. The nozzle plate according to claim 1, wherein a localized fluorine concentration at a select location between adjacent nozzle openings is lower than the first fluorine concentration.

3. The nozzle plate according to claim 1, wherein a static contact angle of the lip is 70° or more with respect to $H_2O$.

4. A nozzle plate having a plurality of nozzle openings, the nozzle plate comprising:

a base; and a diamond-like carbon film on the base, wherein the diamond-like carbon film contains fluorine, and a fluorine concentration progressively decreases from a maximum concentration between adjacent nozzle openings toward each nozzle opening.

5. A method of manufacturing a nozzle plate comprising:

providing a base, the base having a plurality of nozzle openings;

providing a fluorine-containing diamond-like carbon film on the base, a fluorine concentration in the fluorine-containing diamond-like carbon film decreasing from a surface of the diamond-like carbon film toward the base; and treating the fluorine-containing diamond-like carbon film so that:

a lip of each nozzle opening has a first fluorine concentration, the surface of the diamond-like carbon film has a second fluorine concentration, and the first fluorine concentration is lower than the second fluorine concentration.

6. The method of claim 5 wherein the treating further comprises:

scraping the surface of the fluorine-containing diamond-like carbon film and the lip of each nozzle opening.

7. The method of claim 5 wherein the treating further comprises:

creating a depression in the fluorine-containing diamond-like carbon film between adjacent nozzle openings with a laser; and thermally annealing the fluorine-containing diamond-like carbon film.

* * * * *